US009439000B1

(12) United States Patent
Daley

(10) Patent No.: US 9,439,000 B1
(45) Date of Patent: Sep. 6, 2016

(54) SYSTEMS AND METHODS FOR IMPROVED AUDIO OUTPUT IN ELECTRONIC DEVICES

(71) Applicant: GOOGLE INC., Mountain View, CA (US)

(72) Inventor: Michael Daley, Santa Clara, CA (US)

(73) Assignee: GOOGLE INC., Mountain View, CA (US)

( * ) Notice: Subject to any disclaimer, the term of this patent is extended or adjusted under 35 U.S.C. 154(b) by 15 days.

(21) Appl. No.: 14/193,723

(22) Filed: Feb. 28, 2014

(51) Int. Cl.
*H04R 17/00* (2006.01)
*H04R 31/00* (2006.01)

(52) U.S. Cl.
CPC ..... *H04R 17/00* (2013.01); *H04R 31/00* (2013.01)

(58) Field of Classification Search
CPC .. H04R 17/00; H04R 31/00; H04R 2499/11; H04R 19/005; H04R 2400/03
USPC ..... 381/190, 151, 162, 191, 17; 29/594, 29/25.35, 896.2; 257/416; 709/204; 348/734, 335
See application file for complete search history.

(56) References Cited

U.S. PATENT DOCUMENTS

| | | | | |
|---|---|---|---|---|
| 8,543,168 | B2 | 9/2013 | Zurek et al. | |
| 2003/0059068 | A1* | 3/2003 | Bank | G06F 1/1616 381/152 |
| 2012/0149437 | A1* | 6/2012 | Zurek | H04M 1/0266 455/566 |
| 2014/0016014 | A1* | 1/2014 | Yokoyama | H02N 2/0015 348/335 |
| 2015/0104047 | A1* | 4/2015 | Izumi | H04M 1/03 381/162 |

* cited by examiner

*Primary Examiner* — Md S Elahee
(74) *Attorney, Agent, or Firm* — Marshall, Gerstein & Borun LLP

(57) ABSTRACT

Embodiments are provided for devices for audio playback and configuring devices for audio playback. According to certain aspects, an electronic device is configured with an exterior casing that has a cutout area formed thereon. A vibrating panel is disposed within the cutout area and secured to the exterior casing such that the vibrating panel is substantially co-planar with the exterior casing. A transducer is disposed in proximity to the vibrating panel. When the transducer receives an audio signal, the transducer mechanically vibrates which causes the vibrating panel to actuate and produce audio output. The embodiments enable effective and efficient design and improve the user experience.

21 Claims, 6 Drawing Sheets

SYSTEMS AND METHODS FOR IMPROVED AUDIO OUTPUT IN ELECTRONIC DEVICES

FIELD

This application generally relates to audio output in electronic devices. In particular, the application relates to an active panel area that is built into a casework portion of an electronic device, where the active panel area actuates to produce an acoustic frequency response.

BACKGROUND

Various known electronic devices support audio playback or output through audio components such as built in speakers. For example, a user may use a built in speaker for audio playback in situations in which the user does not have or does not wish to use headphones or earbuds. In existing electronic devices, the built-in speakers lack substantial acoustic source strength. This is sometimes due to the generally small size of some electronic devices such as smart phones, whereby it is undesirable for the speakers to take up a large surface area of the electronic device. Further, existing speakers do not take advantage of the maximum amount of air volume in electronic devices, which impacts excursion ability and therefore the acoustic response.

Accordingly, there is an opportunity to implement acoustic components that allow for improved audio playback.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Figure 1A:
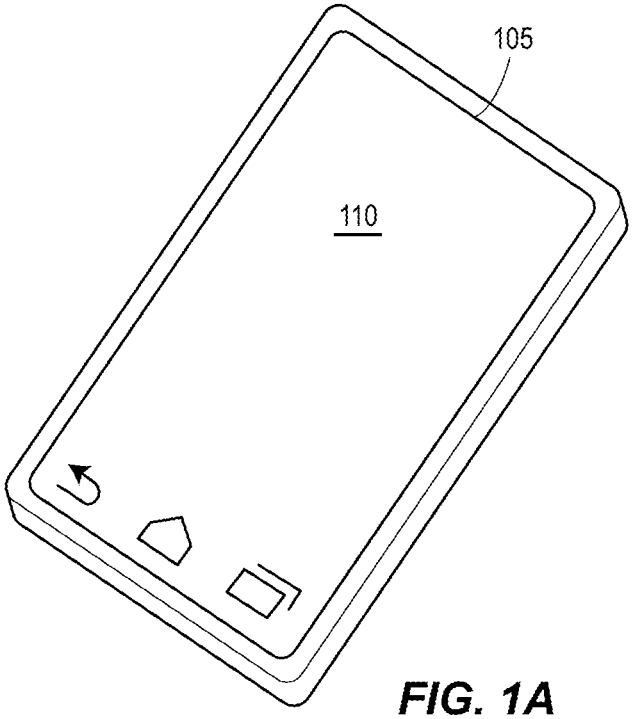
FIGS. 1A and 1B depict example representations of an electronic device capable of facilitating audio output in accordance with some embodiments.

Embodiments as detailed herein enable an electronic device to play or output audio via a vibrating panel and transducer that in combination leverage the design of the electronic device. In particular, the transducer and vibrating panel leverage the surface area of the electronic device, which enables larger audio components and results in better acoustic source strength. Further, the design of the transducer and vibrating panel eliminates the need for an amount of interior volume in the electronic device that is otherwise necessary in conventional speaker designs.

In conventional devices, the speakers have to be specially designed to fit the associated device and, to produce adequate sound, often take up valuable space within the device. Further, the speakers often do not leverage the entire existing air volume of the device. According to the present embodiments, an electronic device includes an exterior casing the encloses various interior components. For example, an exterior casing of a smartphone may include a front-side display screen or user interface and/or a back-side enclosure. The exterior casing includes a cutout area (e.g., a cutout rectangle that is formed on the exterior casing) in which a vibrating panel may be disposed. In particular, the vibrating panel may be disposed in the exterior casing such that at least a portion of the vibrating panel is substantially co-planar with at least the perimeter of the exterior casing surrounding the cutout area. Accordingly, the vibrating panel does not protrude from the exterior casing.

The vibrating panel may be secured to the exterior casing via various techniques or implementations. In one example, a flexible or compressible gasket may be secured to respective perimeters of the vibrating panel and the exterior casing. In another example, a roll-type surround suspension may secure the vibrating panel to the external casing and enable excursion of the vibrating panel.

The electronic device further includes a transducer that is disposed adjacent to or in close proximity to the vibrating panel. The transducer receives an audio signal from a power source, where the audio signal causes the transducer to correspondingly vibrate. The vibrations from the transducer cause the vibrating panel to actuate (i.e., vibrate) and produce acoustic sound. The sound produced by the vibrating panel may be enhanced by the air volume that is exposed to the vibrating panel, which facilitates effective excursion of the vibrating panel. In some embodiments, a port formed through the external casing may further enhance the frequency response of the sound produced by the vibrating panel.

The embodiments as discussed herein offer many benefits. In particular, the vibrating panel and transducer components can leverage a larger surface area of the electronic device which results in an air volume deflection that is greater than what is possible in a conventional device speaker. Further, the vibrating panel and transducer do not require the extra volume of air between the diaphragm and exterior casing that exists in conventional diaphragm designs, which represents a space savings that enables more design possibilities. Of course, the embodiments further offer benefits to device users, as the vibrating panel produces quality sound that is enhanced by leveraging the air volume already defined in the electronic device.

It should be noted that the disclosures in this specification are made and intended to be interpreted to their broadest extent under the patent laws, and that while the systems and methods described herein may be employed broadly in numerous applications and embodiments consistent with their capabilities, nothing in this disclosure is intended to teach, suggest, condone, or imply noncompliance with any other law or regulation that may be applicable to certain usages or implementations of the systems and methods. For example, while the systems and methods disclosed herein are technologically capable of playback of media files, such capabilities and functionalities should not be construed as a teaching, recommending, or suggesting use of such capabilities and functionalities in a manner that does not comply with all applicable existing laws and regulations, including without limitation, applicable national, state, and common law privacy or copyright laws. Again, such broad disclosure is intended for compliance with and interpretation under the patent laws and regulations.

Figure 1B:
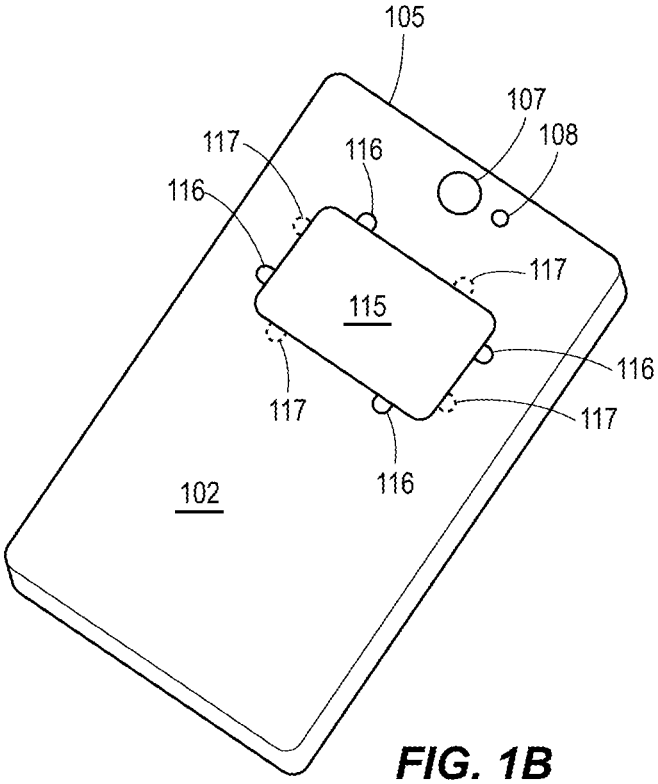

FIGS. 1A and 1B depict separate views of an example electronic device 105 capable of facilitating acoustic output. The electronic device 105 may be, for example, a handheld wireless device, such as a mobile phone, a Personal Digital Assistant (PDA), a smart phone, a tablet or laptop computer, a multimedia player, an MP3 player, a digital broadcast receiver, a remote controller, or any other electronic apparatus. Although the embodiments envision the electronic device 105 as portable and hand-held, it should be appreciated that other non-portable devices are envisioned.

At least a portion of the electronic device 105 may include an exterior casing 102 that takes up various portions or exterior surfaces of the electronic device 105. The exterior casing 102 may be designed to house or enclose various interior components of the electronic device 105. The exterior casing 102 may include one or multiple pieces or components, and may be composed of various materials (e.g., plastic, metal, glass, etc.) or combinations of materials. For example, an exterior casing 102 of a smartphone may include a front-side display screen or user interface and a back-side non-display screen surface. It should be appreciated that the external casing 102 of an electronic device may include all non-display screen components.

FIG. 1A illustrates a front side or surface of the electronic device 105. In particular, the front side of the electronic device 105 includes a user interface 110 (which can include a display screen and various I/O components, as understood in the art). FIG. 1B illustrates a back side or surface of the electronic device 105 (or otherwise the side opposite from the user interface 110). The back side of the electronic device 105 can optionally include an imaging sensor (i.e., a camera) 107 and an associated flash component 108. It should be appreciated that the components and arrangements thereof that are included on either the front side or the back side of the electronic device 105 are merely examples, and that alternative or additional components and arrangements thereof are envisioned.

The exterior casing 102 of the back side of the electronic device 105 may have a cutout area formed therethrough or thereon. The cutout area may be sized to fit a vibrating panel 115 that is configured to facilitate acoustic output originating as an audio signal within the electronic device 105. The vibrating panel 115 may be composed of various materials or combinations of materials. For example, the vibrating panel may be composed of one or more metals, plastics, glasses, etc. FIG. 1B illustrates the vibrating panel 115 (and associated cutout area) as roughly centered in the top half of the back side of the electronic device 105 and roughly one eighth (⅛) the surface area of the back side of the electronic device. However, it should be appreciated that the positioning, size, and shape of the vibrating panel 115 (and cutout area) are merely examples and other positions, sizes, and shapes for the vibrating panel 115 (and cutout area) are envisioned.

The vibrating panel 115 may be secured to the electronic device 105 via various techniques or components. For example, a set of front tabs 116 can be positioned over the back side and can prevent the vibrating panel 115 from collapsing into the electronic device 105 (e.g., via a user pushing on the vibrating panel 115). Further, a set of back tabs 117 can be positioned under the back side and can prevent the vibrating panel 115 from being removed from the cutout area (e.g., via a user pulling on the vibrating panel 115). The sets of tabs 116, 117 may be composed of the same material(s) as the vibrating panel 115 or of a different material(s). Additional techniques and components for securing the vibrating panel 115 to the electronic device 105 are described in further figures.

Figure 2A:
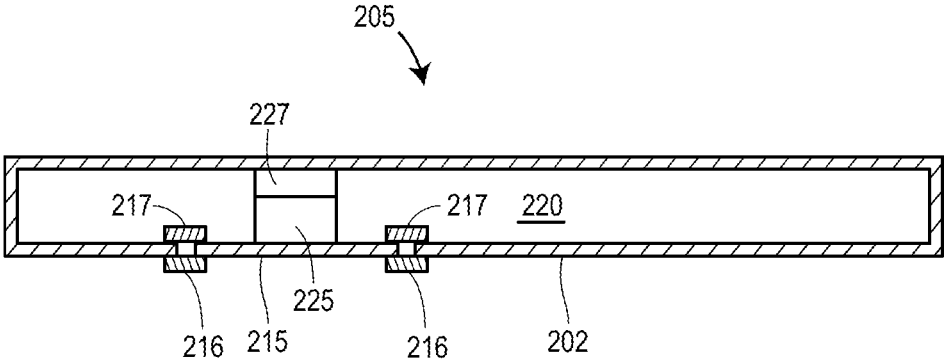
FIGS. 2A and 2B depict cross section views of an example electronic device in accordance with some embodiments.

FIG. 2A illustrates a cross-section view of an electronic device 205 (such as the electronic device 105 discussed with respect to FIG. 1). The electronic device 205 includes a vibrating panel 215 disposed within a cutout area of an exterior casing 202. The vibrating panel 215 is optionally secured to the exterior casing 202 via two sets of tabs 216, 217 or other types of fasteners. In embodiments, the vibrating panel 215 may be secured to the exterior casing 202 via an attachment or suspension mechanism. In some implementations, the attachment mechanism may consist of a perimeter of a generally compliant material such as, for example, foam. In other implementations, the attachment mechanism may consist of a roll-surround-type suspension.

The electronic device 205 further includes at least one transducer 225 that is located proximate (i.e., adjacent or near-adjacent) to the interior side of the vibrating panel 215. In operation, when an audio signal in the form of an electrical current is passed to the transducer 225, the transducer 225 vibrates and mechanically causes the vibrating panel 215 to also vibrate. When the vibrating panel 215 vibrates, the vibrating panel 215 outputs acoustic sound corresponding to the audio signal. These types of transducers 225 are sometimes referred to as "exciters" or "shakers." It should be appreciated that various types of transducers 225 are envisioned, such as electrodynamic transducers, piezoelectric transducers, and/or the like.

In some implementations, the electronic device 205 can include a support component 227 disposed between the transducer 225 and a portion of the exterior casing 202 (or another surface of the electronic device 205), wherein the support component 227 acts to physically support the transducer 225. The support component 227 may be composed of various materials or combinations of materials, such as foam, epoxy, and/or the like. In other embodiments, the transducer 225 may be physically supported by any internal component or surface of the electronic device 205. In further embodiments, there may be an air gap between the transducer 225 and the exterior casing 202 (or another surface of the electronic device 205).

As illustrated in FIG. 2A, the design of the electronic device 205 may define an air volume 220 within the exterior casing 202, wherein the air volume 220 is generally defined as an area that is not taken up by components of the electronic device 205. In specific implementations incorporating the vibrating panel 215, the air volume 220 may be defined as the volume of air that is exposed to the interior side of the vibrating panel 215. Generally, the air volume 220 enhances the displacement or vibration (i.e., excursion) capability of the vibrating panel 215 and therefore enhances the frequency response of the audio output.

Figure 2B:
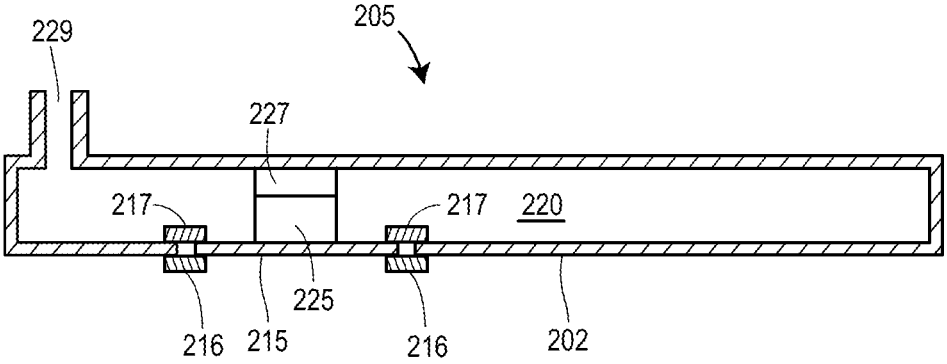

FIG. 2B depicts a cross-section view of an alternative design for the electronic device 205. The electronic device 205 of FIG. 2B includes a port 229 that extends through the exterior casing 202 (or another surface of the electronic device 205) and into the air volume 220 such that each of the port 229 and the vibrating panel 215 is exposed to the air volume 220. In some embodiments, the port 229 may be incorporated into an existing jack, port, or socket of the electronic device 205. For example, the port 229 may be a 3.5 mm headphone jack, a USB port, or another jack or port. Although illustrated as generally narrow, it should be appreciated that the port 229 can be of various shapes and sizes.

The port 229 may be designed and positioned such that its acoustic resonance is tuned by optimal selection of its cross-sectional area and length to provide enhanced audio output (e.g., additional low frequency acoustic radiation) via the vibrating panel 215.

Figure 3A:
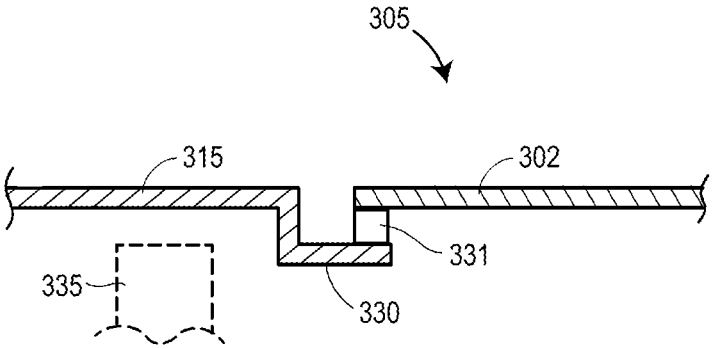
FIGS. 3A-3C depict detailed cross section views of an example electronic device in accordance with some embodiments.
Figure 3B:
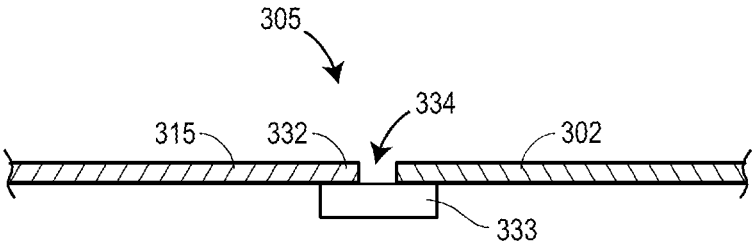
Figure 3C:
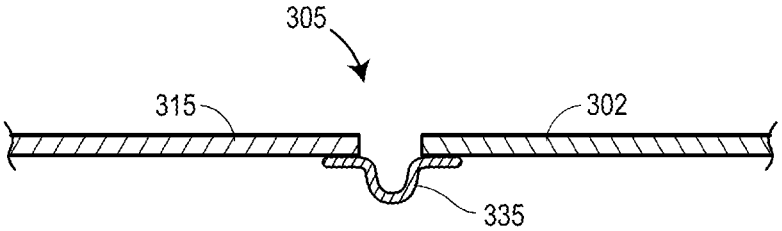

FIGS. 3A-3C illustrate detailed cross-section views of an electronic device 305 (such as the electronic devices 105, 205 as described with respect to FIGS. 1, 2A, and 2B). In particular, FIGS. 3A-3C illustrate various implementations for mechanisms that secure a vibration panel 315 to an exterior casing 302 of the electronic device 305.

FIG. 3A depicts an end portion 330 of the vibration panel 315 that extends below the plane defined by the exterior casing 302 and extends beneath the exterior casing 302 a certain amount. By extending beneath the exterior casing 302, the end portion 330 affects to prevent the vibration panel 315 from being pulled or removed from the cutout area of the exterior casing 302. It should be appreciated that the end portion 330 of the vibration panel 315 and the vibration panel 315 may be composed of the same or different materials. In an optional implementation, a support component 335 may be located or disposed within the interior of the electronic device 305, where the support component 335 affects to prevent the vibration panel 315 from being pushed or collapsed into the interior of the electronic device 305.

The electronic device 305 of FIG. 3A further includes a gasket 331 that is positioned between the end portion 330 and the exterior casing 302, where the gasket 331 creates a mechanical seal between the end portion 330 and the exterior casing 302. The gasket 331 may be disposed along an entire perimeter of the end portion 330 of the vibrating panel 315 (and therefore a perimeter of the exterior casing 302 that surrounds the cutout area). The gasket 331 may be composed of various flexible or compressible materials such as foam, rubber, cork, felt, neoprene, or the like. The gasket 331 further helps prevent the vibrating panel 315 from being pulled or removed from the cutout area of the exterior casing 302, and from being pushed or collapsed into the interior of the electronic device 305. It should be appreciated that the position and size of the gasket 331 as depicted in FIG. 3A is merely an example and that other positions and sizes of the gasket 331 are envisioned.

FIG. 3B depicts an end portion 332 of the vibration panel 315 that is substantially co-planer with the exterior casing 302, wherein a gap 334 exists between the end portion 332 and the exterior casing 302. The electronic device 305 of FIG. 3B further includes a gasket 333 that is disposed below both of the end portion 332 of the vibrating panel 315 and the exterior casing 302, affecting to secure the end portion 332 to the exterior casing 302 and create an acoustic seal between the end portion 332 and the exterior casing 302. The gasket 333 may be composed of various flexible or compressible materials such as foam, rubber, cork, felt, neoprene, or the like. The gasket 333 further helps prevent the vibrating panel 315 from being pulled or removed from the cutout area of the exterior casing 302, and from being pushed or collapsed into the interior of the electronic device 305. It should be appreciated that the position and size of the gasket 333 as depicted in FIG. 3B is merely an example and that other positions and sizes of the gasket 333 are envisioned.

FIG. 3C depicts a roll-surround suspension 335 that is disposed between the vibration panel 315 and the exterior casing 302. The roll-surround suspension 335 is composed of a flexible material (e.g., rubber) and enables the vibrating panel 315 to displace above and below (i.e., "excursion") the exterior casing 302 when the vibrating panel 315 is subject to a mechanical force. The roll-surround suspension 335 may be disposed along a perimeter of the vibrating panel 315 and a perimeter of the exterior casing 302 that surrounds the cutout area. Further, similar to the gaskets 331, 333 of FIGS. 3A and 3B, the roll-surround suspension 335 helps prevent the vibrating panel 315 from being pulled or removed from the cutout area of the exterior casing 302, and from being pushed or collapsed into the interior of the electronic device 305. It should be appreciated that the position and size of the roll-surround suspension 335 as depicted in FIG. 3C is merely an example and that other positions and sizes of the roll-surround suspension 335 are envisioned.

Figure 4A:
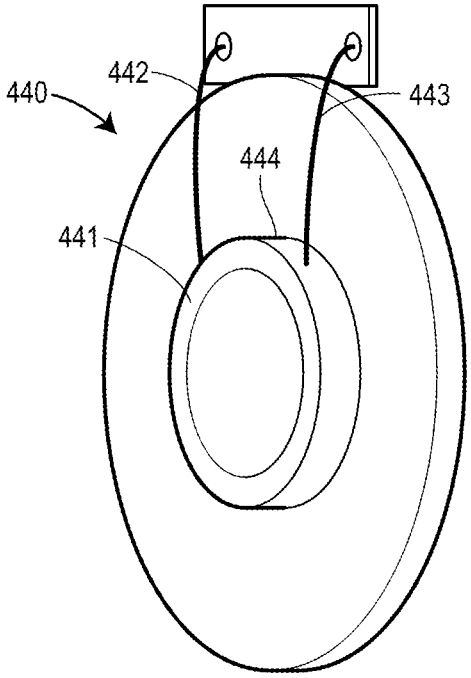
FIGS. 4A and 4B depict example transducers that may be disposed in an electronic device in accordance with some embodiments.
Figure 4B:
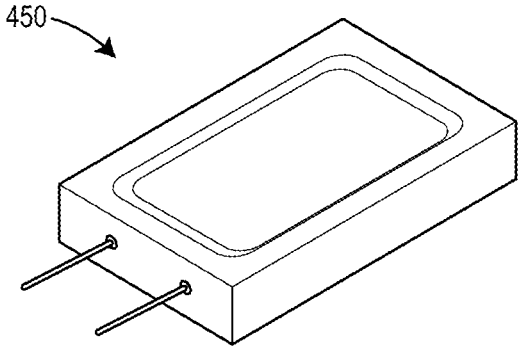

FIGS. 4A and 4B depict example transducers that may be incorporated into the embodiments described herein. The transducers may be disposed in an electronic device to facilitate audio output, such as the implementations described with respect to FIGS. 2A and 2B. It should be appreciated that the transducers depicted in FIGS. 4A and 4B are merely examples and other types and sizes of transducers are envisioned.

FIG. 4A illustrates a circular-type transducer 440 that may be disposed adjacent or proximate to a vibrating panel of an electronic device. In particular, the transducer 440 includes a contact area 441 that is configured to contact the vibrating panel (or contact another material or component that then contacts the vibrating panel), whereby the total contact area of the transducer 440 is less than the surface area of the vibrating panel. In operation, when an audio signal in the form of an electrical current is passed to a voice coil 444 via a set of leads 442, 443, a magnetic field is created and the contact area 441 vibrates and causes the vibrating panel to also vibrate and therefore output acoustic sound.

FIG. 4B illustrates another type of transducer 450 that may be representative of one or more components present in a "micro speaker." The transducer 450 may be of different sizes (e.g., 13×18×4.5 mm, or other sizes) and may also be disposed adjacent or proximate to a vibrating panel of an electronic device. Similar to the transducer 440 of FIG. 4A, mechanical vibrations of the transducer 450 cause the vibrating panel to vibrate and therefore output acoustic sound.

Figure 5:
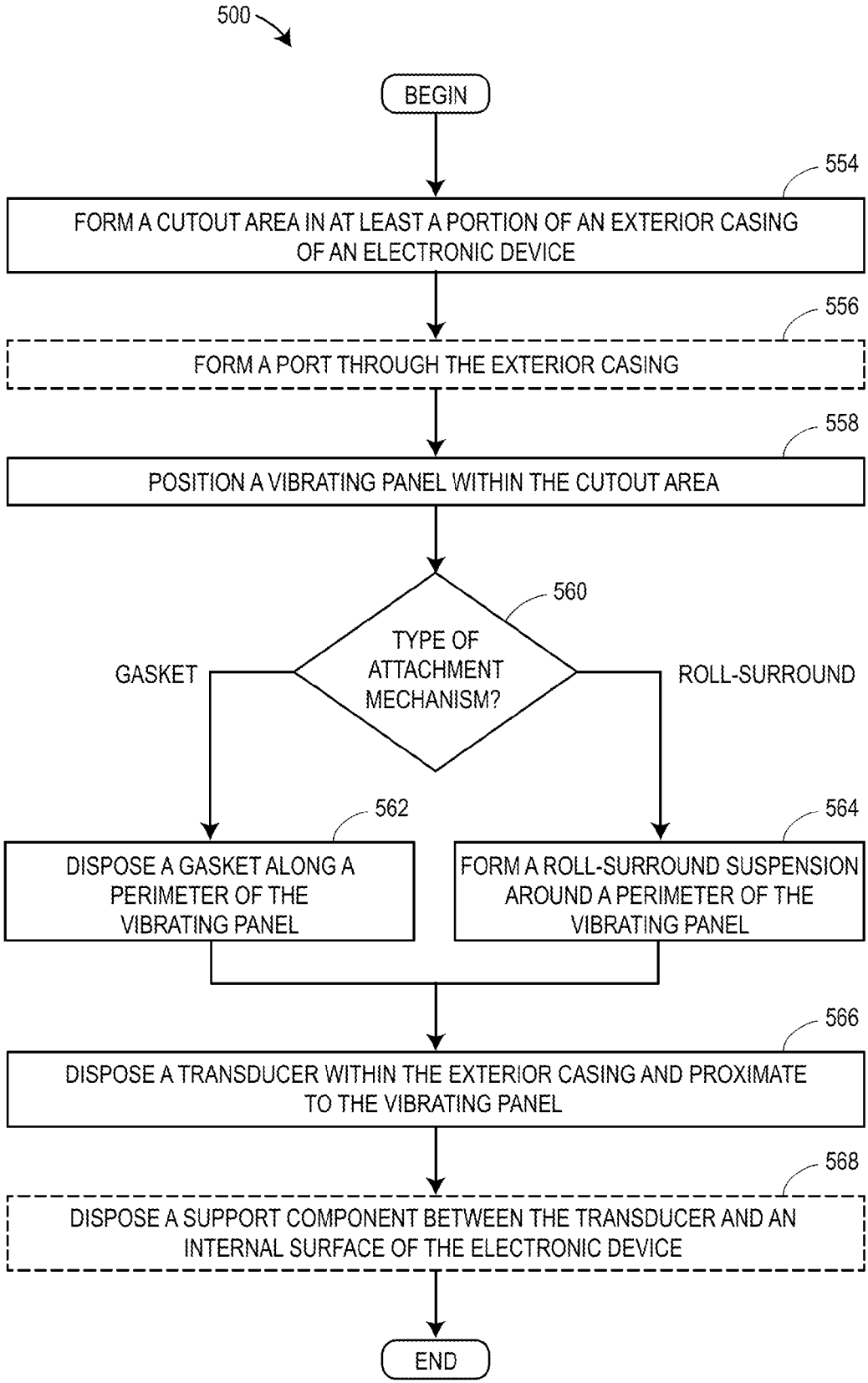
FIG. 5 depicts a flow diagram of configured an electronic device for acoustic output in accordance with some embodiments.

FIG. 5 is a flowchart of a method 500 for configuring an electronic device for acoustic audio output. The method 500 begins with forming 554 a cutout area in at least a portion of an exterior casing of an electronic device. For example, if the electronic device is a smartphone, the cutout area may be formed on a back surface that is opposite from a display screen. Optionally, a port may be formed 556 through the exterior casing, where the port may be incorporated into existing jacks or sockets of the electronic device.

A vibrating panel may be positioned 558 within the cutout area, such that the vibrating panel is substantially co-planer with at least the portion of the exterior casing. The vibrating panel may be secured 560 to the exterior casing according to various techniques or components. If a gasket component is to be used ("GASKET"), the gasket may be disposed 562 along a perimeter of the vibrating panel. In some cases, a gasket may be positioned between the exterior casing and an end portion of the vibrating panel that is disposed underneath a perimeter of the exterior casing surrounding the cutout area (as illustrated in FIG. 3A). In other cases, a gasket may be positioned underneath the respective perimeters of the vibrating panel and the exterior casing (as illustrated in FIG. 3B). If a roll-surround suspension is to be used ("ROLL-SURROUND"), the roll-surround suspension may be formed 564 around a perimeter of the vibrating panel and a perimeter of the exterior casing surrounding the cutout area, where the roll-surround suspension enables excursion of the vibrating panel.

A transducer may be disposed 566 within the exterior casing and proximate to the vibrating panel. According to embodiments, the transducer may be of various types, sizes, and shapes, and is configured to vibrate in response to an electrical signal and cause the vibrating panel to actuate and produce sound. Optionally, a support component may be disposed 568 between the transducer and an internal surface of the electronic device. For example, the support component may be a compliant material such as foam the supports the transducer within the electronic device.

Figure 6:
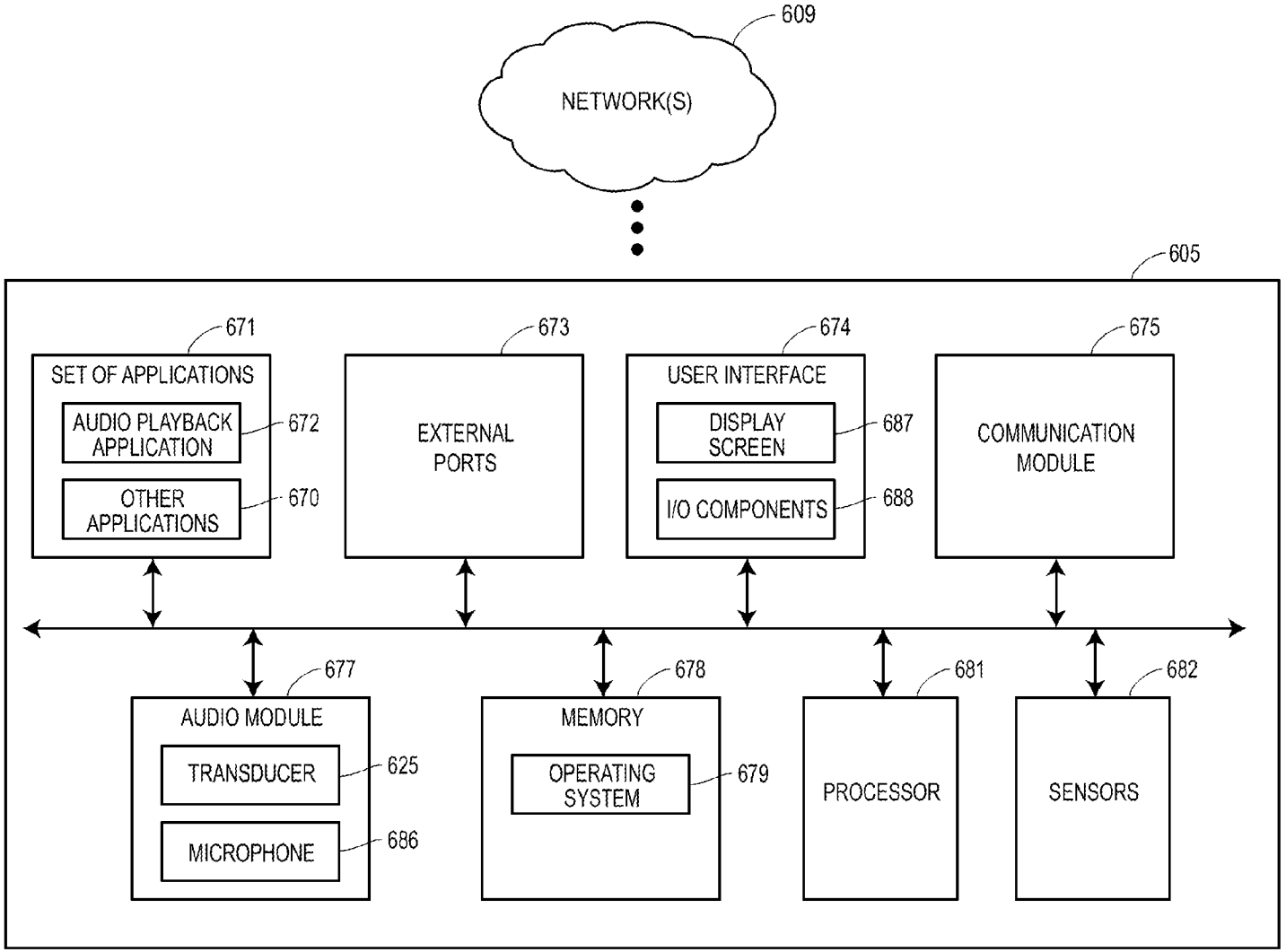
FIG. 6 is a block diagram of an electronic device in accordance with some embodiments.

FIG. 6 illustrates an example electronic device 605 in which the embodiments as discussed herein may be implemented. The electronic device 605 can include a processor 681 or other similar type of controller module or microcontroller, as well as a memory 678. The memory 678 can store an operating system 679 capable of facilitating various functionalities as known in the art. The processor 681 can interface with the memory 678 to execute the operating system 679, as well as execute a set of applications 671 such as an audio playback application 672 and one or more other applications 670 (which the memory 678 can also store). The memory 678 can include one or more forms of volatile and/or non-volatile, fixed and/or removable memory, such as read-only memory (ROM), electronic programmable read-only memory (EPROM), random access memory (RAM), erasable electronic programmable read-only memory (EEPROM), and/or other hard drives, flash memory, MicroSD cards, and others.

The electronic device 605 can further include a communication module 675 configured to interface with the one or more external ports 673 to communicate data via one or more networks 609. According to some embodiments, the communication module 675 can include one or more transceivers functioning in accordance with IEEE standards, 3GPP standards, or other standards, and configured to receive and transmit data via the one or more external ports 673. More particularly, the communication module 675 can include one or more WWAN, WLAN, and/or WPAN transceivers configured to connect the electronic device 605 to various devices and components.

The electronic device 605 can further include one or more sensors 682 such as, for example, imaging sensors, accelerometers, touch sensors, and other sensors. The electronic device 605 can include an audio module 677 including hardware components such as a transducer 625 for processing audio signals as discussed herein and a microphone 686 for detecting or receiving audio. In operation, the transducer 625 can receive an audio signal from a power source (e.g., via the processor 681) and mechanically vibrate according to the audio signal.

The electronic device 605 may further include a user interface 674 to present information to the user and/or receive inputs from the user. As shown in FIG. 6, the user interface 674 includes a display screen 687 and I/O components 688 (e.g., capacitive or resistive touch sensitive input panels, keys, buttons, lights, LEDs, cursor control devices, haptic devices, and others). In embodiments, the display screen 687 is a touchscreen display using singular or combinations of display technologies and can include a thin, transparent touch sensor component superimposed upon a display section that is viewable by a user. For example, such displays include capacitive displays, resistive displays, surface acoustic wave (SAW) displays, optical imaging displays, and the like.

In general, a computer program product in accordance with an embodiment includes a computer usable storage medium (e.g., standard random access memory (RAM), an optical disc, a universal serial bus (USB) drive, or the like) having computer-readable program code embodied therein, wherein the computer-readable program code is adapted to be executed by the processor 681 (e.g., working in connection with the operating system 679) to facilitate the functions as described herein. In this regard, the program code may be implemented in any desired language, and may be implemented as machine code, assembly code, byte code, interpretable source code or the like (e.g., via C, C++, Java, Actionscript, Objective-C, Javascript, CSS, XML, and/or others).

Thus, it should be clear from the preceding disclosure that the systems and methods offer improved audio playback implementations. The embodiments improve the user experience by enabling improved audio frequency response. Further, the embodiments advantageously leverage various features of electronic device design to improve audio playback while maintaining or improving the aesthetic appearance of the electronic devices.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An electronic device for facilitating acoustic output, comprising:

an exterior casing comprising at least a first surface and a second surface opposite from the first surface, the first surface including a user interface;

a vibrating panel disposed within a cutout area of the second surface of the exterior casing, wherein the vibrating panel, when disposed within the cutout area, is (i) substantially co-planar with the second surface of the exterior casing and (ii) secured to the second surface of the exterior casing via an attachment mechanism disposed along at least a portion of a perimeter of the vibrating panel;

a transducer disposed within the exterior casing and proximate to the vibrating panel; and a power source configured to apply an electrical signal to the transducer to cause the vibrating panel to actuate and produce sound.

2. The electronic device of claim 1, wherein the exterior casing encloses an air volume, wherein at least a portion of an interior surface of the vibrating panel is exposed to the air volume.

3. The electronic device of claim 1, wherein the exterior casing comprises a port formed therethrough, wherein each of the port and the vibrating panel is exposed to an air volume within the exterior casing.

4. The electronic device of claim 1, wherein the transducer is a piezoelectric transducer.

5. The electronic device of claim 1, wherein the transducer is an electrodynamic transducer.

6. The electronic device of claim 1, further comprising:

a support component disposed between the transducer and an internal surface of the electronic device.

7. The electronic device of claim 1, wherein the transducer is supported by an internal component of the electronic device.

8. The electronic device of claim 1, wherein the attachment mechanism comprises at least one set of tabs disposed along the perimeter of the vibrating panel.

9. The electronic device of claim 1, wherein the attachment mechanism comprises a roll-surround suspension that enables excursion of the vibrating panel.

10. The electronic device of claim 1, wherein the attachment mechanism comprises a generally compliant material.

11. An apparatus adapted to facilitate acoustic output, comprising:

an exterior casing having a cutout area formed therethrough, wherein the cutout area is located on a side of the exterior casing opposite from a display screen;

a vibrating panel disposed within the cutout area so that, when the vibrating panel is disposed within the cutout area, (i) at least a portion of the vibrating panel is substantially co-planar with a portion of the exterior casing surrounding the cutout area, and (ii) the vibrating panel is secured to at least some of the portion of the exterior casing surrounding the cutout area via an attachment mechanism disposed along at least a portion of a perimeter of the vibrating panel; and a transducer disposed proximate to the vibrating panel, wherein the transducer is configured to vibrate in response to an applied electrical signal and cause the vibrating panel to actuate and produce sound.

12. The apparatus of claim 11, wherein the exterior casing encloses an air volume, wherein at least a portion of an interior surface of the vibrating panel is exposed to the air volume.

13. The apparatus of claim 12, wherein the exterior casing comprises a port formed therethrough, wherein each of the port and at least the portion of the interior surface of the vibrating panel is exposed to the air volume.

14. The apparatus of claim 11, wherein the perimeter of the vibrating panel extends underneath the portion of the exterior casing surrounding the cutout area.

15. The apparatus of claim 14, wherein the attachment mechanism is a gasket that is disposed between an upper surface of the perimeter of the vibrating panel and an interior surface of the portion of the exterior casing surrounding the cutout area.

16. The apparatus of claim 11, wherein the perimeter of the vibrating panel extends above the portion of the exterior casing surrounding the cutout area.

17. A method of configuring an electronic device for acoustic audio output, the method comprising:

forming a cutout area in at least a portion of an exterior casing of the electronic device, wherein the portion of the exterior casing is opposite from a user interface of the electronic device;

positioning a vibrating panel within the cutout area so that when the vibrating panel is positioned within the cutout area, the vibrating panel is substantially co-planar with at least the portion of the exterior casing;

securing the vibrating panel (i) to at least the portion of the exterior casing, and (ii) within the cutout area via an attachment mechanism disposed along at least a portion of a perimeter of the vibrating panel; and disposing a transducer within the exterior casing and proximate to the vibrating panel, wherein the transducer is configured to vibrate in response to an electrical signal and cause the vibrating panel to actuate and produce sound.

18. The method of claim 17, further comprising:

forming a port through the exterior casing, wherein each of the port and the vibrating panel is exposed to an air volume within the exterior casing.

19. The method of claim 17, further comprising:

disposing a support component between the transducer and an internal surface of the electronic device.

20. The method of claim 17, wherein securing the vibrating panel (i) to at least the portion of the exterior casing and (ii) within the cutout area via the attachment mechanism comprises:

disposing a gasket along a perimeter of the vibrating panel.

21. The method of claim 17, wherein securing the vibrating panel (i) to at least the portion of the exterior casing and (ii) within the cutout area via the attachment mechanism comprises:

forming a roll-surround suspension around the perimeter of the vibrating panel, wherein the roll-surround suspension enables excursion of the vibrating panel.

* * * * *